United States Patent [19]

Weinstein et al.

[11] 4,165,889

[45] Aug. 28, 1979

[54] STEP-IN HEEL UNIT FOR SKI BINDING

[75] Inventors: Burton A. Weinstein, Pelham Manor, N.Y.; Gordon C. Lipe, Teton Village, Wyo.

[73] Assignee: The Garcia Corporation, Teaneck, N.J.

[21] Appl. No.: 926,240

[22] Filed: Jul. 20, 1978

[51] Int. Cl.[2] ..... A63C 9/08

[52] U.S. Cl. ..... 280/626; 280/618

[58] Field of Search ..... 280/626, 632, 631, 618, 280/613, 611

[56] References Cited

U.S. PATENT DOCUMENTS

| | | | |
|---|---|---|---|
| 3,351,355 | 11/1967 | Bruckl | 280/632 |
| 3,944,237 | 3/1976 | Teague, Jr. | 280/618 |
| 4,113,277 | 9/1978 | Zoor | 280/626 |

*Primary Examiner*—David M. Mitchell

*Attorney, Agent, or Firm*—Fitzpatrick, Cella, Harper & Scinto

[57] ABSTRACT

A step-in safety ski binding comprises a stirrup mounted to a support, a boot clasp is rotatably mounted to the stirrup and includes a first part which engages the ski boot sole and a second part which pivots on the bridging section of the stirrup. An elastic locking mechanism is provided laterally between the sole engaging part and the stirrup legs so that the boot sole can be automatically locked therein and is releasable therefrom upon application of a predetermined minimum separation force.

7 Claims, 6 Drawing Figures

FIG.1
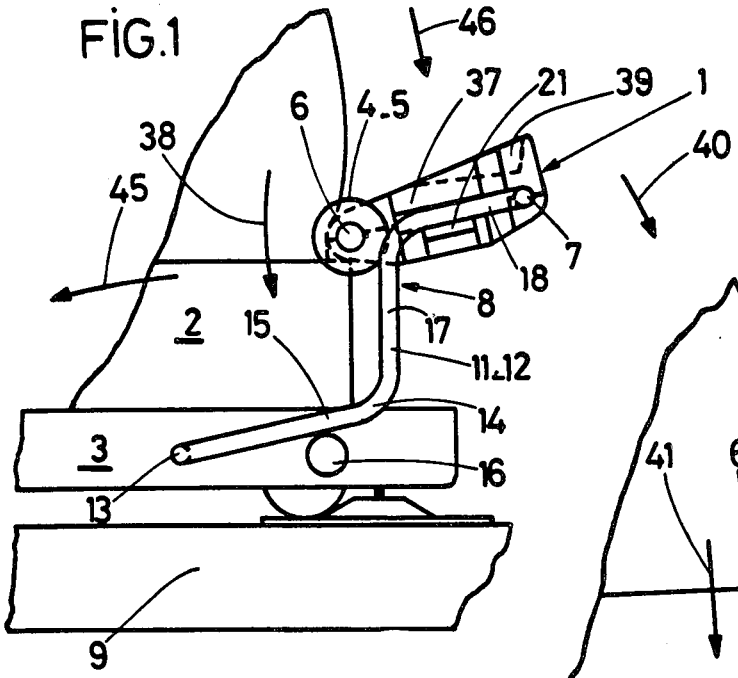
FIG.2
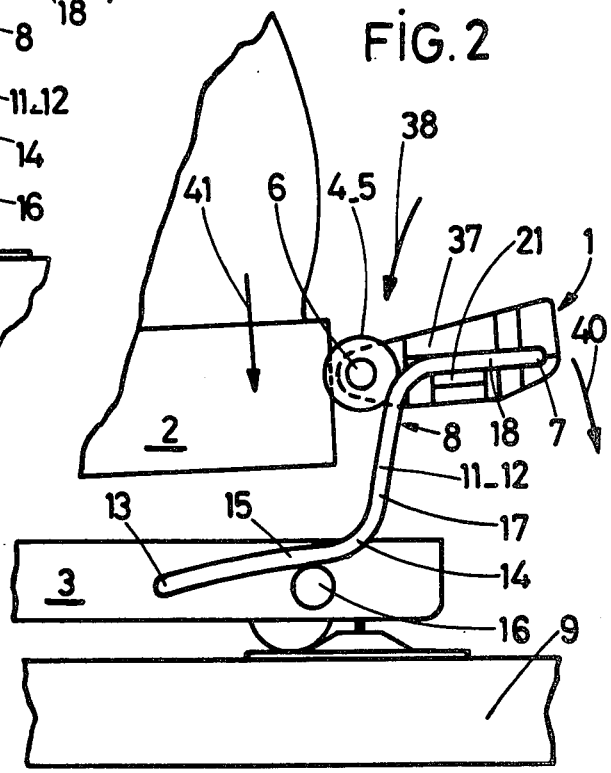
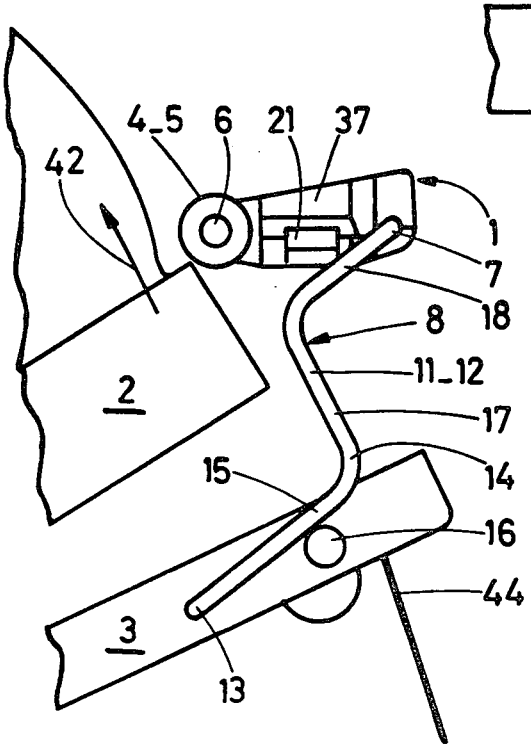
FIG.3

STEP-IN HEEL UNIT FOR SKI BINDING

BACKGROUND OF THE INVENTION

The present invention relates generally to safety ski bindings, and more particularly to a heel unit for a safety ski binding which permits automatic release of the ski boot upon application of a predetermined minimal separation force and also has automatic step-in capabilities permitting locking of the ski boot sole without manual intervention.

In known ski bindings of this kind, such as the one described in French Pat. No. 1,572,250, an elastic locking means is provided laterally between a sole catch and the side branches of a stirrup. The locking means comprises tumblers pivoted on the sole catch on horizontal axes, a part of the tumblers being subjected to a spring, while another part cooperates with the side branches of the stirrup. Such known ski binding is relatively complex, which does not enable it to be as small as desirable. Furthermore, such a binding must be reclosed manually around the sole of the boot.

The ski binding, according to the invention, avoids the disadvantages of the prior art. Though having a structure simpler than that of the prior art, it affords the same safety on release in case the skier falls and, furthermore, enables the skier to put on his binding automatically, without manual intervention, by simply stepping into the binding mechanism.

SUMMARY OF THE INVENTION

In accordance with the present invention, a binding comprises a sole catch, a first part of which is designed to lock the end of a boot sole placed on a support, and a second part capable of pivoting on a bridge arranged transverse to the support and parallel to the bearing plane of the latter on the sole; the bridge being the transverse portion of a stirrup having two legs bent in relation to the bridge and connected, by their opposite ends, to the two sides of the support respectively adjacent the sides of the end of the boot sole; elastic locking means are provided laterally between the sole catch and the legs, whereby rotation of the sole catch around the bridge is possible only when a predetermined minimum effort is exerted upwardly by the edge of the sole on the first part of the sole catch.

The locking means consist, on each side of the sole catch, of a ramp integral with the latter, working together with the adjacent leg of the stirrup. Each leg is elastically deformable laterally under the action of the ramp only when a predetermined minimum effort is exerted upwardly by the edge of the sole on the first part of the sole catch. A stop is placed on each side of the sole catch and works together with the adjacent stirrup leg to prevent the downward rotation of the sole catch around the bridge. The two stirrup legs are also elastically deformable in a plane parallel to the longitudinal axis of the support and perpendicular to the bearing plane of the latter. Means are provided to keep the sole catch a predetermined distance above the support so as to enable the ski binding to be locked on the boot automatically. Without departing from the scope of this invention, a single ramp, placed on one side of the sole catch, and a single stop, whether placed on the same side or not, can each work together with a single leg of the stirrup; the ramp or ramps, as the case may be, can be adjustable in position, for example, by lateral sliding in relation to the sole catch.

In some embodiments, in which the legs are pivotally mounted on the support, the means for keeping the sole catch a predetermined distance above the support consist of at least one stop integral with at least one leg of the stirrup, capable of working together with the support or with the ski. This stop can, for example, consist of a bent intermediate part of one of the legs of the stirrup. It can also consist of a part of said leg placed between said bent part and the pivot point of the leg on the support.

In other embodiments, the means for keeping the sole catch a predetermined distance above the support consist of a device preventing the pivoting of the legs at their point of connection with the support; for example, the legs can be firmly fastened to the support; they can also be detachable, but shaped to be adjusted in the support so as not to be able to turn in relation to said support.

In other embodiments, each leg of the stirrup contains a wound intermediate part forming at least one turn, one part of which works together with the corresponding ramp. That turn can, for example, when the stirrup is in skiing position, be placed roughly over the rest of the leg; its part roughly farthest from the rest of the leg works together with the ramp; the part roughly diametrically opposite the turn can advantageously constitute the bent part serving as a stop to keep the sole catch a predetermined distance above the support.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 1 is a side view of a first embodiment of the invention, in skiing position;

FIG. 2 is a side view of the same embodiment as FIG. 1, illustrating engagement;

FIG. 3 is a side view of the same embodiment as FIG. 1, illustrating release;

DESCRIPTION OF THE INVENTION

Figure 4:
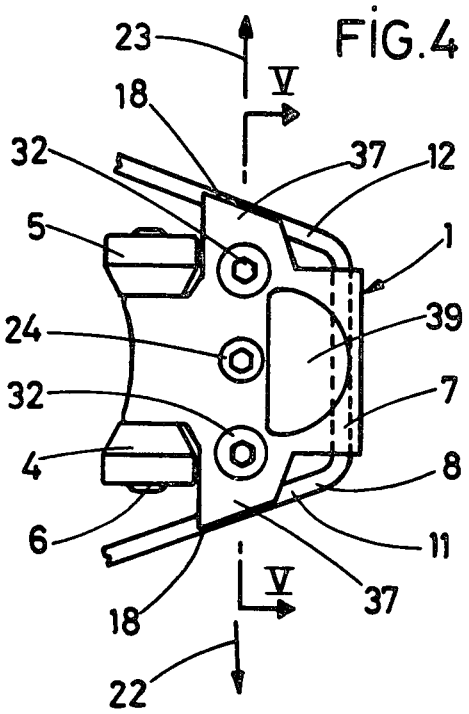
FIG. 4 is a plan view of the first embodiment of the invention.

With reference to FIGS. 1 to 4, the ski safety binding comprises a sole catch 1, a first part of which is provided to engage and lock the end of a sole 2 of a boot in order to keep the latter on a support 3. The first part has two rollers 4 and 5 arranged to be placed respectively on each side of sole 2; the rollers being cone-shaped in order to match the shape of sole 2. The rollers are pivoted on a shaft 6, placed parallel to the upper face of the support and transverse to the longitudinal axis of the latter, supported by sole catch 1. As illustrated, support 3 consists of a sole plate itself forming part of a safety device wherein sole catch 1 constitutes a second safety feature which is capable of being released only after release of the first safety device. The second safety feature is important, notably, when the first safety device contains a foot plate which is connected to ski 9, even after release, by a flexible cable subjected, for example, to the action of an elastic tension device. Without departing from the scope of this invention, support 3 could consist of ski 9 itself, sole catch 1 constituting in that case the only safety release device.

Sole catch 1 is pivoted by a second part, farther from the end of sole 1 than the first, on a bridge 7 of a stirrup 8. Bridge 7 is arranged parallel to shaft 6, transverse to support 3, and is connected to support 3 by legs 11 and 12 having inwardly turned feet pivotally supported within openings 13 provided respectively on each side of support 3. Legs 11 and 12 are bent at 14 to assume a rough S-shape; one of their parts 15, close to bent part 14, is provided to bear on a stop 16 integral with each side of support 3. A second part 17 maintains sole catch 1 a specific distance upwardly from support 3 and from the ski.

Figure 5:
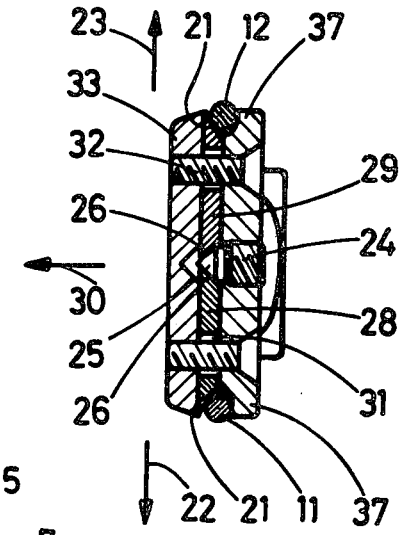
FIG. 5 is a sectional view taken along lines V—V of FIG. 4.

A locking device is laterally provided between sole catch 1 and legs 11 and 12. It consists, first of all, of a ramp 21 placed on each side of sole catch 1; each ramp 21 works together with the top part 18 of the corresponding leg 11 or 12, which is elastically deformable laterally in the direction of arrows 22 and 23 (FIG. 4). Each ramp 21 is situated, when the binding is in skiing position (FIG. 1), below the corresponding leg 11 or 12, and is oriented in the direction of the latter. Preferably, ramps 21 are mounted on sole catch 1 so as to be adjustable in the direction of arrows 22 or 23 crosswise to sole catch 1. As represented in FIG. 5, an adjusting screw 24 has, for that purpose, a cone-shaped end 25 which engages two other ramps 26 provided at one end of two sliding elements 28 and 29 that in turn have ramps 21 at their other end. Thus, the axial displacement of screw 24 in the direction of arrow 30 separates elements 28 and 29, in the direction of arrow 22 and 23 respectively, to adjust the position of the two ramps 21 to the exact spacing of legs 11 and 12. Sliding elements 28 and 29 contain oblong openings 31 through which pass fastening screws 32, the threaded end of which is engaged with threaded openings provided in a plate 33. The locking of screws 32 immobilizes sliding elements 28 and 29 between sole catch 1 proper and plate 33.

Sole catch 1 further includes, on each of its side parts, a stop 37 working together with the corresponding leg 11 or 12 in order to prevent the rotation of sole catch 1 around bridge 7, downwardly in the direction of arrow 38 (FIGS. 1 and 2). Finally, dished area 39 is provided at the top of sole catch 1 (FIGS. 1 and 4), the purpose of which will be described hereinafter.

Legs 11 and 12 are also elastically deformable in the direction of arrow 40 (FIGS. 1 and 2), in a plane parallel to the longitudinal axis of support 3 and perpendicular to the bearing plane of sole 2 on the latter.

To lock into the binding, the end of the sole of boot 2 is brought into contact with rollers 4 and 5 and then, as represented on FIG. 2, the sole is shifted in the direction of arrow 41, which produces an elastic deformation of the legs 11 and 12 and a rotation, in the direction of arrow 40 of bridge 7 about an axis defined by stops 16. At the same time, rollers 4 and 5 are temporarily separated from sole 2. When sole 2 is borne on support 3, legs 11 and 12 elastically resume their rest position, rollers 4 and 5 then being lodged on the upper edge of sole 2, as represented in FIG. 1. The safety binding is thus in skiing position. If packed snow, for example, gets in between sole 2 and support 3, the binding is put on in the same way, but in this case a slight play exists, after putting it on, between stops 16 and parts 15 of legs 11 and 12 which does not hamper the binding capabilities.

In the event the skier falls, when a predetermined minimum separation effort is exerted, upwardly, for example, in the direction of arrow 42, between the edge of sole 2 and support 3, ramps 21 push back laterally, in the direction of arrows 22 and 23 respectively (FIG. 4), legs 11 and 12, which are thus elastically deformed, permitting rotation, in the direction of arrow 43, of sole catch 1 around bridge 7 of stirrup 8. As represented in FIG. 3, rollers 4 and 5 thus free sole 2 of the boot. As can be seen in FIG. 3, this release occurs only when support 3 has by itself already separated from the ski and a flexible cable 44, joining the latter to the ski, has reached the limit of extension. The release of sole catch 1 would take place in the same way if support 3 consisted of ski 9 itself.

To take off the binding at will, it is necessary only to exert in the direction of arrow 46 an effort on sole catch 1 with, for example, a ski pole inserted in dished part 39 (FIG. 1); legs 11 and 12 thus yield in the direction of arrow 40 and the edge of sole 2 is released.

When not skiing, legs 11 and 12 may be rotated, in the direction of arrow 45 (FIG. 1), from the position where they are bearing on stops 16 and are advantageously flattened, together with sole catch 1, against support 3. Sole catch 1 is thus reduced in size, more favorable for carrying the skis.

According to a variant of the first embodiment, not represented in the drawing, bent parts 14 and stops 16 are eliminated and legs 11 and 12, instead of being hinged at 13 in support 3, are secured at 13 in said support 3 so that they cannot turn in relation to the latter. All of the other elements are identical to those of the first embodiment previously described. The operation of the unit is likewise similar.

Figure 6:
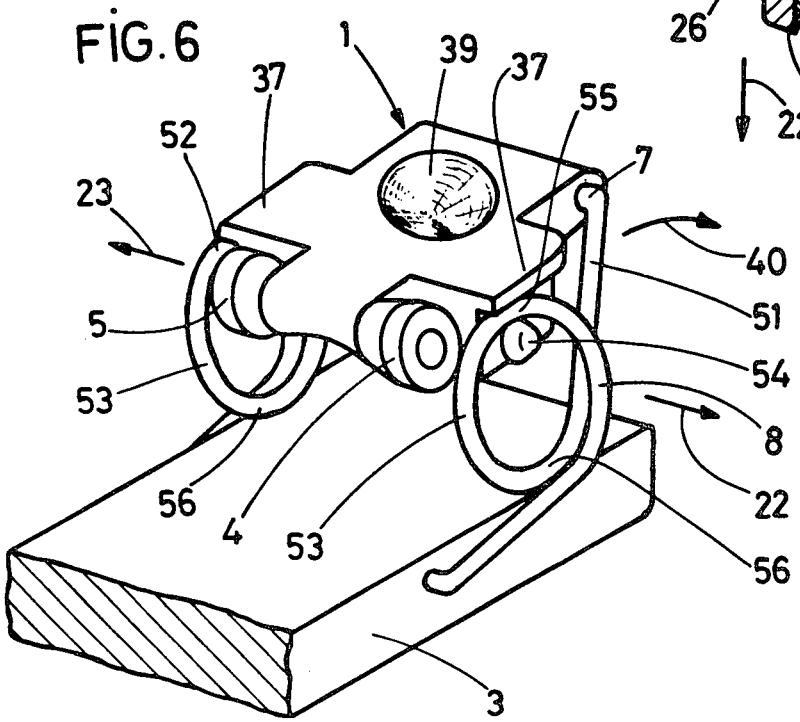
FIG. 6 is a perspective view of a second embodiment of the invention.

In a second embodiment of the invention, illustrated in FIG. 6, the S-shaped legs 11 and 12 of the first embodiment are replaced by legs 51 and 52, each of which contains an intermediate part forming a turn 53. Ramps 21 of FIGS. 1 to 5 are replaced by cone-shaped ramps 54. When stirrup 8 is in skiing position, each turn 53 is set roughly over the rest of the corresponding leg 51 or 52. The top area 55 of the leg works together with the corresponding cone-shaped ramp 54 (FIG. 6). An area 56 of each turn 53, roughly opposite area 55, is provided to serve as a stop during skiing in order to keep sole catch 1 a predetermined distance above support 3 and thus enable the ski binding to be put on automatically. All of the other elements and operation are identical to those of the first embodiment. The presence of turns 53 favors the elastic deformation of legs 51 and 52 laterally in the direction of arrows 22 or 23 as well as longitudinally in the direction of arrow 40.

The ski safety binding, object of the invention, can be used in all cases where such a binding must have a very small volume, while easily enabling it to be put on automatically. While represented herein as a heel unit, the invention may also conceivably be used as a toe binding.

What is claimed is:

1. A safety ski binding which comprises:

a stirrup having a bridging section and a pair of legs;

means mounting the ends of said legs to the sides of a support for a ski boot;

a boot sole engaging clamp having a first element constructed and arranged to engage the end of said boot sole, and a second element pivotally connected to the bridging section of said stirrup rearwardly at the end of said boot sole and parallel to the bearing plane of said sole on said support;

elastic locking means constructed and arranged laterally between said clamp and said stirrup legs, said locking means including at least one ramp integral with a side of said clamp arranged to cooperate with a leg of said stirrup which is elastically deformable laterally under the action of said ramp, and a stop constructed and arranged on at least one side of said clamp to engage a leg of said stirrup whereby downward rotation of said clamp is prevented; and means for maintaining said first element a predetermined distance above said support;

the legs of said stirrup also being elastically deformable in a plane parallel to the longitudinal axis of said support and perpendicular to the bearing plane of said support whereby said clamp is rotatable at said second element to release said boot sole upon application of a predetermined minimum release force.

2. Ski binding according to claim 1, wherein said at least one ramp is laterally adjustable in relation to said clamp.

3. Ski binding according to claim 1, wherein said stirrup legs are pivotally mounted to said support, and said means for maintaining said first element a predetermined distance above said support comprises at least one stop integral with at least one of said stirrup legs or said support.

4. Ski binding according to claim 1, wherein said means for maintaining said first element a predetermined distance above said support comprises an element preventing the pivoting of said legs at their point of connection with said support.

5. Ski binding according to claim 3, wherein said stirrup legs are a Z-shaped configuration and said stops are arranged on the sides of said support to engage the lower area of each leg.

6. Ski binding according to claim 1, wherein each of said legs has a coiled intermediate part, a part of which engages said ramp and is deformable both laterally and longitudinally.

7. Ski binding, according to claim 6, wherein said means maintaining said first element a predetermined distance above said support comprises the lower portion of said coil, said lower portion being constructed and arranged to engage the upper surface of said support.

* * * * *